US008679296B2

(12) United States Patent
Qin et al.

(10) Patent No.: US 8,679,296 B2
(45) Date of Patent: Mar. 25, 2014

(54) HIGH BULK TISSUE COMPRISING EXPANDABLE MICROSPHERES

(75) Inventors: Jian Qin, Appleton, WI (US); Deborah Joy Calewarts, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 13/562,710

(22) Filed: Jul. 31, 2012

(65) Prior Publication Data

US 2014/0034254 A1 Feb. 6, 2014

(51) Int. Cl.
*D21H 21/00* (2006.01)
*D21H 21/54* (2006.01)

(52) U.S. Cl.
USPC ..... 162/158; 162/123; 162/164.1; 162/168.1

(58) Field of Classification Search
None
See application file for complete search history.

(56) References Cited

U.S. PATENT DOCUMENTS

| | | | | |
|---|---|---|---|---|
| 3,293,114 | A | 12/1966 | Kenaga et al. | |
| 3,556,934 | A | 1/1971 | Meyer | |
| 3,867,169 | A | 2/1975 | Shimizu | |
| 4,133,688 | A | 1/1979 | Sack | |
| 4,483,889 | A | 11/1984 | Andersson | |
| 4,619,734 | A | 10/1986 | Andersson | |
| 5,514,429 | A | 5/1996 | Kamihgaraguchi et al. | |
| 5,723,021 | A * | 3/1998 | Nguyen | 162/168.1 |
| 6,365,641 | B1 | 4/2002 | Masuda et al. | |
| 6,379,497 | B1 | 4/2002 | Sandstrom et al. | |
| 6,537,680 | B1 * | 3/2003 | Norlander et al. | 428/532 |
| 6,846,529 | B2 | 1/2005 | Froass et al. | |
| 6,903,143 | B2 | 6/2005 | Masuda et al. | |
| 6,984,347 | B2 | 1/2006 | Masuda et al. | |
| 7,351,752 | B2 | 4/2008 | Miki et al. | |
| 7,482,046 | B2 | 1/2009 | Williams et al. | |
| 7,943,011 | B2 | 5/2011 | Reed et al. | |
| 7,955,657 | B2 | 6/2011 | Froissard et al. | |
| 7,955,670 | B2 | 6/2011 | Swoboda et al. | |
| 7,956,096 | B2 | 6/2011 | Nordin et al. | |
| 8,013,041 | B2 | 9/2011 | Solhage | |
| 8,030,365 | B2 | 10/2011 | Mohan et al. | |
| 2002/0104632 | A1 * | 8/2002 | Jimenez et al. | 162/158 |
| 2002/0180075 | A1 | 12/2002 | Masuda et al. | |
| 2004/0043139 | A1 | 3/2004 | Daniels | |
| 2005/0026067 | A1 | 2/2005 | Masuda et al. | |
| 2005/0080151 | A1 | 4/2005 | Miki et al. | |
| 2006/0063000 | A1 | 3/2006 | Tokumura et al. | |
| 2006/0102307 | A1 | 5/2006 | Kron et al. | |
| 2006/0131362 | A1 | 6/2006 | Bergenudd et al. | |
| 2006/0134010 | A1 | 6/2006 | Nordin et al. | |
| 2007/0023141 | A1 | 2/2007 | Mehan et al. | |
| 2007/0044929 | A1 | 3/2007 | Mohan et al. | |
| 2007/0137813 | A1 * | 6/2007 | Nickel et al. | 162/109 |
| 2007/0287776 | A1 | 12/2007 | Nordin et al. | |
| 2008/0017338 | A1 | 1/2008 | Nordin et al. | |
| 2008/0293838 | A1 | 11/2008 | Miki et al. | |
| 2009/0165976 | A1 | 7/2009 | Soane et al. | |
| 2010/0051220 | A1 | 3/2010 | Hong et al. | |
| 2011/0036526 | A1 * | 2/2011 | Williams et al. | 162/164.6 |
| 2011/0088860 | A1 * | 4/2011 | Heijnesson-Hulten et al. | 162/164.1 |
| 2011/0155338 | A1 | 6/2011 | Zhang et al. | |

FOREIGN PATENT DOCUMENTS

| | | | |
|---|---|---|---|
| WO | WO 2004/113613 | A1 | 12/2004 |
| WO | WO 2006/068573 | A1 | 6/2006 |
| WO | WO 2006/068574 | A1 | 6/2006 |
| WO | WO 2007/091960 | A1 | 8/2007 |
| WO | WO 2007/091961 | A1 | 8/2007 |

* cited by examiner

*Primary Examiner* — Richard Crispino
*Assistant Examiner* — Eric Yaary
(74) *Attorney, Agent, or Firm* — Kimberly-Clark Worldwide, Inc.

(57) ABSTRACT

The disclosure relates to high bulk tissue webs containing microspheres. To form the tissue webs, a nonionic polymer dispersion, such as polyvinyl alcohol stabilized vinyl acetate-ethylene copolymer dispersion, is mixed with microspheres and incorporated into tissue webs to increase sheet bulk.

9 Claims, 1 Drawing Sheet

HIGH BULK TISSUE COMPRISING EXPANDABLE MICROSPHERES

BACKGROUND

In the manufacture of soft tissue products such as facial, bath and towel tissue, an aqueous suspension of papermaking fibers is deposited onto a forming fabric from a headbox. The newly-formed web is thereafter dewatered and dried, and in certain instances creped to form a soft tissue sheet. The trend in premium tissue manufacture has been to provide softer, bulkier, less stiff sheets by layering, throughdrying and basis weight reductions. Layering, which requires a headbox equipped with headbox dividers, enables the tissue manufacturer to engineer the tissue by placing softer feeling fibers in the outer layers while placing the stronger fibers, which generally do not feel as soft, in the middle of the tissue sheet. Throughdrying enables the manufacturer to produce a bulky sheet by drying the sheet with air in a noncompressive state. Reducing the basis weight of the sheet reduces its stiffness and, when used in conjunction with throughdrying, a single-ply tissue sheet of adequate caliper and performance for a premium product can be attained.

However, producing a premium tissue product of adequate softness, bulk and strength is not easily accomplished. For example, layering requires the purchase of a layered headbox, which is expensive. Higher bulk can be achieved by embossing, but embossing normally requires a relatively stiff sheet in order for the sheet to retain the embossing pattern. Increasing sheet stiffness negatively impacts softness. Conventional embossing also substantially reduces the strength of the sheet and may lower the strength below acceptable levels in an effort to attain suitable bulk. Reducing the basis weight of the sheet will decrease its stiffness, but may require that two or more of such low basis weight sheets be plied together to retain the desired caliper and performance.

Accordingly there is a need for a simple means of enabling conventional tissue machines to produce premium quality tissue sheets having adequate softness, bulk and strength without the expense of purchasing a layered headbox or a throughdryer, or manufacturing multiple plies.

SUMMARY

It has now been surprisingly discovered that premium quality tissue sheets having adequate softness, bulk and strength may be produced by the addition of expandable microspheres without the use of cationic retention aids. Rather than rely upon cationic retention aids to improve the retention and distribution of expandable microspheres within the tissue web, the inventors have discovered expandable microspheres may be mixed with a nonionic polymer dispersion, particularly a polyvinyl alcohol stabilized vinyl acetate-ethylene copolymer dispersion, and added to the tissue web to improve bulk.

Accordingly, in one embodiment the present disclosure provides a tissue web comprising cellulosic fibers, expandable microspheres, and a nonionic polymer dispersion.

In other aspects the present disclosure provides a tissue web comprising cellulosic fibers, pre-expanded thermoplastic microspheres, and a polyvinyl alcohol stabilized vinyl acetate-ethylene copolymer.

In yet other embodiments the disclosure provides an uncreped tissue web comprising cellulosic fibers, expandable microspheres, and a nonionic polymer dispersion, wherein the uncreped web has a basis weight from about 10 to about 30 gsm and a bulk of at least about 15 cc/g.

In still other embodiments the disclosure provides an creped tissue web comprising cellulosic fibers, expandable microspheres, and a nonionic polymer dispersion, wherein the creped web has a basis weight from about 10 to about 30 gsm and a bulk of at least about 10 cc/g.

In other embodiments the disclosure provides tissue web comprising cellulosic fibers, expandable microspheres, and a vinyl acetate-ethylene copolymer. In a particularly preferred embodiment the vinyl acetate-ethylene copolymer is provided as an aqueous dispersion comprising a vinyl acetate-ethylene copolymer dispersed in an aqueous medium comprising a stabilizer. In a particularly preferred embodiment the vinyl acetate-ethylene copolymer is prepared by the copolymerization of vinyl acetate and ethylene monomers in the presence of about 4 to 10 weight percent polyvinyl alcohol, based on vinyl acetate monomer.

In yet other embodiments the present disclosure provides a method of forming a tissue web comprising the steps of forming an nonionic polymer dispersion comprising a vinyl acetate-ethylene copolymer, polyvinyl alcohol and a surfactant; mixing expandable microspheres with the nonionic polymer dispersion to form an aqueous dispersion; forming a slurry of cellulosic fibers; mixing the aqueous dispersion and the cellulosic fiber slurry to form a mixture; disposing the mixture on a forming fabric to form a tissue web; and drying the tissue web.

Other features and aspects of the present disclosure are discussed in greater detail below.

DESCRIPTION OF THE DRAWINGS

Illustrated in FIGS. 1A and 1B are SEM micrographs of a control tissue handsheet (FIG. 1A) and a tissue handsheet comprising expandable microspheres (FIG. 1B).

Illustrated in FIGS. 2A and 2B are SEM micrographs of a control UCTAD tissue web (FIG. 2A) and an UCTAD tissue web comprising expandable microspheres (FIG. 2B).

DEFINITIONS

Figure 1A:
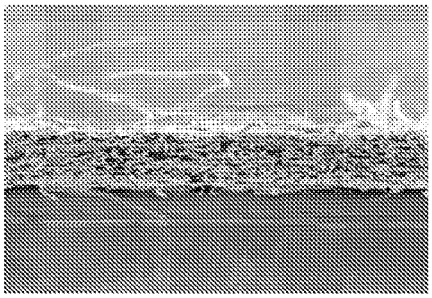
Figure 1B:
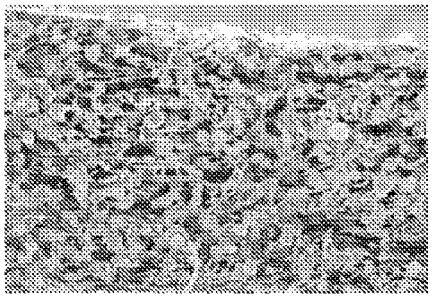

As used herein the term "dispersion" generally refers to a polymer dispersed in an aqueous continuous phase. In a preferred embodiment the polymer is dispersed in an aqueous continuous phase by the addition of one or more stabilizers, such as a polyvinyl alcohol. The term "nonionic dispersion polymer" as used herein, means polymer dispersed in an aqueous continuous phase wherein the dispersed polymer possesses a net neutral charge.

As used herein the term "basis weight" generally refers to the bone dry weight per unit area of a tissue. Basis weight is measured herein using TAPPI test method T-220.

As used herein the term "tissue product" generally refers to various paper products, such as facial tissue, bath tissue, paper towels, napkins, and the like. Normally, the basis weight of a tissue product of the present invention is less than about 80 grams per square meter (gsm), in some embodiments less than about 60 gsm, and in some embodiments, from about 10 to about 60 gsm.

The term "bulk" refers to the volume per unit basis of a tissue product and is calculated as the quotient of the caliper expressed in microns, divided by the basis weight, expressed in grams per square meter. The resulting bulk is expressed as cubic centimeters per gram.

As used herein, the term "layer" refers to a plurality of strata of fibers, chemical treatments, or the like, within a ply.

As used herein, the terms "layered tissue web," "multi-layered tissue web," "multi-layered web," and "multi-layered paper sheet," generally refer to sheets of paper prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

The term "ply" refers to a discrete product element. Individual plies may be arranged in juxtaposition to each other. The term may refer to a plurality of web-like components such as in a multi-ply facial tissue, bath tissue, paper towel, wipe, or napkin.

DETAILED DESCRIPTION

According to the present disclosure microspheres are mixed with a nonionic polymer dispersion, and more preferably a nonionic polymer dispersion comprising at least one vinyl acetate-ethylene copolymer, and incorporated into a tissue web to increase sheet bulk. Generally, the bulk of the sheet is increased by about at least 10 percent compared to sheets prepared without microspheres. Surprisingly, the improvement in bulk is achieved without the use of a cationic retention aid, which has been previously used to facilitate retention of the microspheres within the web.

Accordingly in one embodiment the disclosure provides a method of producing a tissue web comprising adding microspheres to a nonionic polymer dispersion to form a mixture, adding the mixture to an aqueous suspension of cellulosic fibers and then dewatering the obtained suspension to form a tissue web. Preferably, the addition of the microsphere-nonionic polymer dispersion mixture to the fiber slurry yields a tissue web wherein the microspheres are substantially uniformly distributed throughout the tissue web.

In a preferred embodiment, the nonionic polymer dispersion comprises at least one vinyl acetate-ethylene copolymer, which comprises vinyl acetate and ethylene monomers polymerized to form the dispersion. In general, the vinyl acetate-ethylene copolymer preferably comprises from 75 to 99 percent by weight vinyl acetate, and from 1 to 25 percent by weight ethylene. Still more preferably the level of vinyl acetate is from 85 to 95 percent by weight and the level of ethylene incorporated is from 5 to 15 percent by weight. In still other embodiments the copolymer comprises 65 to 90 percent by weight vinyl acetate and 10 to 35 percent by weight ethylene, on a monomer basis, to provide a glass transition temperature ($T_g$) ranging from about 10° C. to 20° C., and still more preferably from about 15° C. to about 17° C.

In addition to vinyl acetate and ethylene, one or more other ethylenically unsaturated monomers may also be present in the monomer mixture at up to 15 percent by weight, preferably from 5 to 10 percent by weight of the total polymer solids. Examples of said comonomers include, but are not limited to, comonomers conventionally used in compositions with ethylene and vinyl esters such as acrylates and maleates, e.g. butyl acrylate, and 2-ethylhexyl acrylate. Functional monomers may also be included at up to 10 percent by weight, and preferably from 1 to 5 percent by weight. Examples of suitable functional monomers are carboxylic acids, such as acrylic, methacrylic and maleic acid as well as hydroxyl and amide functional monomers, e.g., hydroxyethylacrylate, hydroxypropylacrylate, acrylamide, N-vinyl formamide, N-vinyl acetamide, and the like. Crosslinking monomers can also be present, such as N-methylol acrylamide, and the n-alkyl esters thereof.

Additionally, certain copolymerizable monomers that assist in the stability of the copolymer dispersion, e.g., vinyl sulfonic acid and 2-acrylamido-2-methylpropane sulfonic acid or their salts may be used herein as latex stabilizers. If present, these stabilizers are added in amounts of from about 0.2 to 1 percent by weight of the monomer mixture.

The initiator is any free radical initiator, or initiator system known in the art. Suitable as polymerization initiators are the water-soluble free-radical-formers generally used in emulsion polymerization, such as hydrogen peroxide, sodium persulfate, potassium persulfate and ammonium persulfate, as well as t-butyl hydroperoxide, in amounts of between 0.01 and 3 percent by weight, preferably 0.1 and 1 percent by weight based on the total amount of the polymer dispersion. They can be used alone or together with reducing agents such as sodium formaldehyde-sulfoxylate, iron-II-salts, sodium dithionite, sodium hydrogen sulfite, sodium sulfite, sodium thiosulfate, ascorbic acid, erythorbic acid as redox catalysts in amounts of 0.01 to 3 percent by weight, preferably 0.1 to 1 percent by weight, based on the total amount of the polymer dispersion. The free-radical-formers can be charged in the aqueous emulsifier solution or be added during the polymerization in doses. Oil soluble initiators such as t-butyl hydrogen peroxide are preferred.

The vinyl acetate-ethylene copolymer is preferably produced in the presence of a stabilizer, such as a polyvinyl alcohol. In certain embodiments the stabilizer may also comprise a surfactant. Suitable polyvinyl alcohols have a degree of polymerization ranging from 200 to 4,000, preferably 500 to 2,500. In certain embodiments the polyvinyl alcohols may be either partially or fully hydrolyzed, or mixtures of both. In a particularly preferred embodiment the polyvinyl alcohol component of the stabilizing system comprises a fully (at least 98 mol %) hydrolyzed polyvinyl alcohol and a partially (86 to 90 mol %) hydrolyzed polyvinyl alcohol in a weight ratio of fully hydrolyzed polyvinyl alcohol to partially hydrolyze polyvinyl alcohol ranging from 3:1 to 1:3.

The amount of stabilizer used in the polymerization reaction is about 4 to about 10 percent based on the weight of vinyl acetate monomer. The stabilizer preferably is added to the polymerization reaction medium all at once prior to initiation, or may be added incrementally during the course of the polymerization, provided a sufficient amount is present initially to provide emulsion stability.

In one particularly preferred embodiment the stabilizer comprises a mixture of fully hydrolyzed polyvinyl alcohol and partially polyvinyl alcohol, preferably 86 to 88 mole % hydrolyzed. The fully and partially hydrolyzed polyvinyl alcohols preferably have a degree of polymerization ranging from 100 to 600, although small amounts of polyvinyl alcohol having a higher degree of polymerization can also be present. The relative amount of each type of polyvinyl alcohol that is used is in the range of 3:1 to 1:3 weight ratio of fully hydrolyzed polyvinyl alcohol to partially hydrolyzed polyvinyl alcohol, desirably at a 1:1 weight ratio.

In addition to polyvinyl alcohol the stabilizer may optionally include a surfactant. The surfactant may be provided in an amount between about 0.01 and 3 percent by weight, preferably 0.1 and 1 percent by weight, based on the total amount of the polymer dispersion. The surfactant may comprise a single surfactant or a blend of surfactants. The surfactants contemplated for the invention include any of the known and conventional surfactants, principally the nonionic and anionic surfactants.

Particularly preferred surfactants are the nonionic surfactants, which include compounds selected from the group consisting of straight chain fatty alcohols containing from about 6 to about 20 carbon atoms, branched chain fatty alcohols containing from about 6 to about 20 carbon atoms, secondary fatty alcohols containing from about 6 to about 20 carbon atoms, branched alcohol ethoxylates condensed with an average of from about 6 to about 15 moles of ethylene oxide per mole of alcohol, secondary alcohol ethoxylates condensed with an average of from about 6 to about 15 moles of ethylene oxide per mole of alcohol, and mixtures thereof. In particularly preferred embodiments the nonionic surfactant component of the stabilizing system may comprise an oxyalkylated product of an alkyl phenol, an aliphatic alcohol, an aliphatic carboxylic acid, or an acetylenic glycol or block copolymers of ethylene oxide and propylene oxide.

Particularly preferred nonionic surfactants are alkoxylated alkylphenols, such as those sold under the trade name Lutensol® (BASF) and octylphenol ethoxylates, such as those sold under the trade name Triton (Dow). Other preferred nonionic surfactants are alkylphenoxy-poly(ethyleneoxy)ethanols having alkyl groups containing from about 7 to 18 carbon atoms, and having from about 4 to 100 ethyleneoxy units, such as the octylphenoxy poly(ethyleneoxy)ethanols, nonylphenoxy poly(ethyleneoxy)ethanols, and dodecylphenoxy poly(ethyleneoxy)ethanols. Other examples of nonionic surfactants include polyoxyalkylene derivatives of hexitol (including sorbitans, sorbides, manitans, and mannides) anhydride, partial long-chain fatty acid esters, such as polyoxyalkylene derivatives of sorbitan monolaurate, sorbitan monopalmitate, sorbitan monostearate, sorbitan tristearate, sorbitan monooleate and sorbitan trioleate.

The polymerization process is a batch process, involving a single reactor with all monomer added prior to commencing the reaction. In general, the process includes charging the reactor initially with vinyl acetate, ethylene, water and any other suitable components. This initial charge represents 100 percent of the total monomer charge. The ingredients may be added in any order without affecting the resultant dispersion. The reactor is then heated to from 40 to 60° C., preferably about 50° C. The reactor is agitated by any suitable means to facilitate dissolution of the ethylene. A portion of the initiator is added to the initial charge, with the remainder added gradually during the reaction to maintain the reaction. Generally the reaction will last several hours, preferably up to 10 hours and most preferably from 1 to 4 hours.

Polymerization is carried out at a pH of between 2 and 7, preferably between 3 and 5. In order to maintain the pH range, it may be useful to work in the presence of customary buffer systems, for example, in the presence of alkali metal acetates, alkali metal carbonates, alkali metal phosphates. Polymerization regulators, including mercaptans such as mercaptoacetic acid and mercaptoethanol; aldehydes; chloroform; methylene chloride and trichloroethylene, may also be added.

The dispersion produced has a high solids level, without the need for an additional concentration step. High solids, as used herein, means that the polymer particles are present in the dispersion at a level of 60 percent by weight or greater, preferably 65 percent by weight or greater, and most preferably greater than 70 percent by weight, based on the dispersion.

In addition to being prepared as described above, certain vinyl acetate-ethylene copolymer dispersions are commercially available and may be useful in preparation of the compositions set forth herein. Suitable commercially available vinyl acetate-ethylene polymers include vinyl alcohol stabilized vinyl acetate-ethylene copolymer dispersions sold under the name Vinnapas™ from Wacker Chemie, AG, Germany, such as Vinnapas™ 323, Vinnapas™ 400, Vinnapas™ 400 H, and Vinnapas™ EF 811, and vinyl acetate ethylene copolymer emulsions from Forbo Adhesives, sold under the name Elvace™, such as Elvace™ 722, Elvace™ 725, Elvace™ 731 and Elvace™ 732. Additional suitable commercially available vinyl acetate ethylene copolymer emulsions include those from Air Products Polymers under the name Airflex™, such as Airflex™ 320, Airflex™ 323, and Airflex™ 400, and those from Celanase under the names Dur-O-Set™ and Resyn™, such as Dur-O-Set™ E-150, Dur-O-Set™ E-200, Dur-O-Set™ E-230, Dur-O-Set™ E-130, Dur-O-Set™ E-200HV, Dur-O-Set™ E-260, Dur-O-Set™ E-100, Dur-O-Set™ E-220, Dur-O-Set™ E-171HS, Dur-O-Set™ C-325, and Resyn™ 1025, Resyn™ 1072, Resyn™ 1601, and Resyn™ SB-321. In certain embodiments two or more of the foregoing commercially available vinyl acetate ethylene copolymers may be blended together to form a nonionic polymer dispersion in which the microspheres may be dispersed.

Upon formation of the nonionic polymer dispersion, microspheres may be introduced to by mixing or the like. In certain embodiments the microspheres may be expandable microspheres and may be provided as either expanded or unexpanded. In a particularly preferred embodiment the microspheres are expanded and mixed with the nonionic polymer dispersion prior to being added to the fiber slurry.

The expandable microspheres preferably comprise a thermoplastic polymer shell encapsulating a propellant. The propellant is preferably a liquid having a boiling temperature not higher than the softening temperature of the thermoplastic polymer shell. Upon heating of thermally expandable microspheres, the propellant increases the internal pressure at the same time as the shell softens, resulting in significant expansion of the microspheres. Both expandable and pre-expanded microspheres are commercially available under the trade name Expancel™ (Akzo Nobel).

Suitable expandable microspheres preferably have a volume median diameter from about 1 to about 500 μm, more preferably from about 5 to about 100 μm, most preferably from about 10 to about 50 μm.

The microspheres may be incorporated into the web by any process of paper formation, including single or multilayered web constructions, and are typically added prior to the headbox during formation of the tissue web. However, they may be added anywhere in the wet end prior to forming the web. In a particularly preferred embodiment the microspheres are added to the middle layer of a three layered web, where they are more readily retained and provide the greatest increase in sheet bulk.

Where expandable microspheres are provided in an unexpanded state, the microspheres may be added to the pulp slurry in an amount from about 5 to about 20 weight percent (based on the weight of pulp fibers) and more preferably from about 10 to about 15 weight percent (based on the weight of pulp fibers). Where expandable microspheres are provided in a pre-expanded state, the microspheres may be added to the pulp slurry in an amount from about 0.5 to about 5 weight percent (based on the weight of pulp fibers) and more preferably from about 1 to about 3 weight percent (based on the weight of pulp fibers).

In one particular embodiment, two percent by weight (based on the weight of pulp fibers) of pre-expanded Expancel™ WE (Akzo Nobel), having a particle diameter of from about 35 to about 55 μm, is mixed with a polyvinyl alcohol stabilized vinyl acetate-ethylene copolymer dispersion, which is then mixed with the softwood fibers furnish used to form the middle layer of a three layered tissue web.

In general, microspheres may be incorporated into any suitable fibrous tissue web. For example, in one aspect, the base sheet can be a tissue product, such as a bath tissue, a facial tissue, a paper towel, a napkin, and the like. Fibrous tissue webs can be made from any suitable types of fiber. Further, the fibrous webs may be incorporated into single-ply fibrous products or multiple-ply fibrous products. For instance, in some aspects, the product may include two plies, three plies, or more.

Fibers suitable for making fibrous webs comprise any natural or synthetic fibers including both nonwoody fibers and woody or pulp fibers. Pulp fibers can be prepared in high-yield or low-yield forms and can be pulped in any known method, including kraft, sulfite, high-yield pulping methods and other known pulping methods. Fibers prepared from organosolv pulping methods can also be used, including the fibers and methods disclosed in U.S. Pat. Nos. 4,793,898, 4,594,130, 3,585,104. Useful fibers can also be produced by anthraquinone pulping, exemplified by U.S. Pat. No. 5,595,628.

The fibrous webs of the present disclosure can also include synthetic fibers. For instance, the fibrous webs can include up to about 10 percent, such as up to about 30 percent or up to about 50 percent or up to about 70 percent or more by dry weight, to provide improved benefits. Suitable synthetic fibers include rayon, polyolefin fibers, polyester fibers, bicomponent sheath-core fibers, multi-component binder fibers, and the like. Synthetic cellulose fiber types include rayon in all its varieties and other fibers derived from viscose or chemically-modified cellulose.

Chemically treated natural cellulosic fibers can be used, for example, mercerized pulps, chemically stiffened or crosslinked fibers, or sulfonated fibers. For good mechanical properties in using web forming fibers, it can be desirable that the fibers be relatively undamaged and largely unrefined or only lightly refined. While recycled fibers can be used, virgin fibers are generally useful for their mechanical properties and lack of contaminants. Mercerized fibers, regenerated cellulosic fibers, cellulose produced by microbes, rayon, and other cellulosic material or cellulosic derivatives can be used. Suitable web forming fibers can also include recycled fibers, virgin fibers, or mixes thereof.

In general, any process capable of forming a web can also be utilized in the present disclosure. For example, a web forming process of the present disclosure can utilize creping, wet creping, double creping, recreping, double recreping, embossing, wet pressing, air pressing, through-air drying, hydroentangling, creped through-air drying, co-forming, air laying, as well as other processes known in the art. For hydroentangled material, the percentage of pulp is about 70 to 85 percent.

Also suitable for articles of the present disclosure are fibrous sheets that are pattern densified or imprinted, such as the fibrous sheets disclosed in any of the following U.S. Pat. Nos. 4,514,345, 4,528,239, 5,098,522, 5,260,171, and 5,624,790, the disclosures of which are incorporated herein by reference to the extent they are non-contradictory herewith. Such imprinted fibrous sheets may have a network of densified regions that have been imprinted against a drum dryer by an imprinting fabric, and regions that are relatively less densified (e.g., "domes" in the fibrous sheet) corresponding to deflection conduits in the imprinting fabric, wherein the fibrous sheet superposed over the deflection conduits was deflected by an air pressure differential across the deflection conduit to form a lower-density pillow-like region or dome in the fibrous sheet.

Tissue webs prepared according to the present disclosure may include a single homogenous layer of fibers or may include a stratified or layered construction. For instance, the fibrous web ply may include two or three layers of fibers. Each layer may have a different fiber composition. For example a three-layered headbox generally includes an upper head box wall and a lower head box wall. Headbox further includes a first divider and a second divider, which separate three fiber stock layers.

Each of the fiber layers comprises a dilute aqueous suspension of papermaking fibers. The particular fibers contained in each layer generally depend upon the product being formed and the desired results. For instance, the fiber composition of each layer may vary depending upon whether a bath tissue product, facial tissue product or paper towel product is being produced. In one aspect, for instance, the middle layer contains southern softwood kraft fibers either alone or in combination with other fibers such as high yield fibers. Outer layers, on the other hand, contain softwood fibers, such as northern softwood kraft. In an alternative aspect, the middle layer may contain softwood fibers for strength, while the outer layers may comprise hardwood fibers, such as eucalyptus fibers, for a perceived softness.

In general, any process capable of forming a base sheet may be utilized in the present disclosure. For example, an endless traveling forming fabric, suitably supported and driven by rolls receives the layered papermaking stock issuing from the headbox. Once retained on the fabric, the layered fiber suspension passes water through the fabric. Water removal is achieved by combinations of gravity, centrifugal force and vacuum suction depending on the forming configuration. Forming multi-layered paper webs is also described and disclosed in U.S. Pat. No. 5,129,988, which is incorporated herein by reference in a manner that is consistent herewith.

Preferably, the formed web is dried by transfer to the surface of a rotatable heated dryer drum, such as a Yankee dryer. In accordance with the present disclosure, the creping composition of the present disclosure may be applied topically to the tissue web while the web is traveling on the fabric or may be applied to the surface of the dryer drum for transfer onto one side of the tissue web. In this manner, the creping composition is used to adhere the tissue web to the dryer drum. In this embodiment, as the web is carried through a portion of the rotational path of the dryer surface, heat is imparted to the web causing most of the moisture contained within the web to be evaporated. The web is then removed from the dryer drum by a creping blade. The creping web as it is formed further reduces internal bonding within the web and increases softness. Applying the creping composition to the web during creping, on the other hand, may increase the strength of the web.

In another embodiment the formed web is transferred to the surface of the rotatable heated dryer drum, which may be a Yankee dryer. The press roll may, in one embodiment, comprise a suction pressure roll. In order to adhere the web to the surface of the dryer drum, a creping adhesive may be applied to the surface of the dryer drum by a spraying device. The spraying device may emit a creping composition made in accordance with the present disclosure or may emit a conventional creping adhesive. The web is adhered to the surface of the dryer drum and then creped from the drum using the creping blade. If desired, the dryer drum may be associated with a hood. The hood may be used to force air against or through the web.

In other embodiments, once creped from the dryer drum, the web may be adhered to a second dryer drum. The second dryer drum may comprise, for instance, a heated drum surrounded by a hood. The drum may be heated from about 25° C. to about 200° C., such as from about 100° C. to about 150° C.

In order to adhere the web to the second dryer drum, a second spray device may emit an adhesive onto the surface of the dryer drum. In accordance with the present disclosure, for instance, the second spray device may emit a creping composition as described above. The creping composition not only assists in adhering the tissue web to the dryer drum, but also is transferred to the surface of the web as the web is creped from the dryer drum by the creping blade. Once creped from the second dryer drum, the web may, optionally, be fed around a cooling reel drum and cooled prior to being wound on a reel.

In addition to applying the creping composition during formation of the fibrous web, the creping composition may also be used in post-forming processes. For example, in one aspect, the creping composition may be used during a print-creping process. Specifically, once topically applied to a fibrous web, the creping composition has been found well-suited to adhering the fibrous web to a creping surface, such as in a print-creping operation.

For example, once a fibrous web is formed and dried the creping composition may be applied to at least one side of the web and the at least one side of the web may then be creped. In general, the creping composition may be applied to only one side of the web and only one side of the web may be creped, the creping composition may be applied to both sides of the web and only one side of the web is creped, or the creping composition may be applied to each side of the web and each side of the web may be creped.

In one embodiment the creping composition may be added to one side of the web by creping, using either an in-line or off-line process. A tissue web is passed through a first creping composition application station that includes a nip formed by a smooth rubber press roll and a patterned rotogravure roll. The rotogravure roll is in communication with a reservoir containing a first creping composition. The rotogravure roll applies the creping composition to one side of web in a preselected pattern. The web is then contacted with a heated roll, which can be heated to a temperature, for instance, up to about 200° C., and more preferably from about 100° C. to about 150° C. In general, the web can be heated to a temperature sufficient to dry the web and evaporate any water. It should be understood, that besides the heated roll, any suitable heating device can be used to dry the web. For example, in an alternative embodiment, the web can be placed in communication with an infra-red heater in order to dry the web. Besides using a heated roll or an infra-red heater, other heating devices can include, for instance, any suitable convective oven or microwave oven.

From the heated roll, the web can be advanced by pull rolls to a second creping composition application station, which includes a transfer roll in contact with a rotogravure roll, which is in communication with a reservoir containing a second creping composition. The second creping composition may be applied to the opposite side of the web in a preselected pattern. The first and second creping compositions may contain the same ingredients or may contain different ingredients. Alternatively, the creping compositions may contain the same ingredients in different amounts as desired. Once the second creping composition is applied the web is adhered to a creping roll by a press roll and carried on the surface of the creping drum for a distance and then removed therefrom by the action of a creping blade. The creping blade performs a controlled pattern creping operation on the second side of the tissue web. Although the creping composition is being applied to each side of the tissue web, only one side of the web undergoes a creping process. It should be understood, however, that in other embodiments both sides of the web may be creped.

Once creped the tissue web may be pulled through a drying station. The drying station can include any form of a heating unit, such as an oven energized by infra-red heat, microwave energy, hot air, or the like. A drying station may be necessary in some applications to dry the web and/or cure the creping composition. Depending upon the creping composition selected, however, in other applications a drying station may not be needed.

The creping compositions of the present disclosure are typically transferred to the web at high levels, such that at least about 30 percent of the creping composition applied to the Yankee dryer is transferred to the web, more preferably at least about 45 percent is transferred and still more preferably at least about 60 percent is transferred. Generally from about 45 to about 65 percent of the creping composition applied to the Yankee dryer is transferred to the web. Thus, the amount of creping additive transferred to the sheet is a function of the amount of creping additive applied to the Yankee dryer.

The basis weight of webs made in accordance with the present disclosure can vary depending upon the final product. In general, the basis weight of the web may vary from about 15 to about 60 gsm, such as from about 15 to about 30 gsm.

In one aspect, fibrous webs made according to the present disclosure can be incorporated into multiple-ply products. For instance, in one aspect, a fibrous web made according to the present disclosure can be attached to one or more other fibrous webs for forming a wiping product having desired characteristics. The other webs laminated to the fibrous web of the present disclosure can be, for instance, a wet-creped web, a calendered web, an embossed web, a through-air dried web, a creped through-air dried web, an uncreped through-air dried web, an airlaid web, and the like.

In one aspect, when incorporating a fibrous web made according to the present disclosure into a multiple-ply product, it may be desirable to only apply the creping composition to one side of the fibrous web and to thereafter crepe the treated side of the web. The creped side of the web is then used to form an exterior surface of a multiple-ply product. The untreated and uncreped side of the web, on the other hand, is attached by any suitable means to one or more plies.

In multiple-ply products, the basis weight of each fibrous web present in the product can also vary. In general, the total basis weight of a multiple-ply product will generally be from about 30 to about 80 gsm, such as from about 32 to about 45 gsm and more preferably from about 35 to about 40 gsm. In particularly preferred embodiments the tissue product is a multi-ply facial tissue wherein each ply has a basis weight from about 15 gsm to about 20 gsm and more particularly from about 16 gsm to about 18 gsm.

Webs made according to the above processes can have relatively good bulk characteristics. For instance, tissue webs have a bulk of at least about 10 cc/g, more preferably at least about 12 cc/g and still more preferably at least about 15 cc/g, such as from about 10 cc/g to about 25 cc/g. In certain instances, bulk may depend on the method of manufacture. Accordingly, creped tissue webs may have a bulk of from about 10 to about 15 cc/g, and uncreped through-air dried webs may have a bulk of from about 15 to 25 cc/g. Surprisingly, it has been discovered that addition of microspheres in the vinyl acetate-ethylene copolymer dispersion of the present disclosure results in tissue products having greater bulk relative to products prepared according to the prior art.

The bulks achieved are from about 10 to about 40 percent greater than tissue products prepared according to the prior art.

EXAMPLES

Example 1

High Bulk Tissue Handsheets

Tissue handsheets comprising Eucalyptus Kraft Pulp and a nonionic polymer dispersion comprising microspheres were prepared as described below. From about 20 to about 320 weight percent (based on dry weight of pulp) of the nonionic polymer dispersion comprising microspheres was added to the pulp diluted slurry inside the head box of the handsheet former and mixed uniformly before the handsheets were formed by removing water.

A nonionic polymer dispersion comprising microspheres, having the composition set forth below, was prepared by mixing a poly(vinyl alcohol) stabilized vinyl acetate-ethylene copolymer dispersion with water for 15 minutes, followed by the addition of nonionic surfactant, biocide and defoamer and mixing for an additional 15 minutes.

Microspheres were then added with mixing for an additional 15 minutes. The weight percentages of individual components are set forth below.

| Vinyl Acetate-Ethylene Copolymer with unexpanded Expancel ™ (VAE - UE) | |
|---|---|
| Component | Weight % |
| Poly(vinyl alcohol) stabilized Vinyl Acetate-Ethylene Copolymer Dispersion | 40% |
| Water | 25% |
| Nonionic Surfactant | 2% |
| Biocide | 0.5% |
| Defoamer | 0.5% |
| Unexpanded Expancel ™ Microspheres (031WUF40, Akzo Nobel) | 32% |

Handsheets were prepared by first measuring the appropriate amount of fiber (0.3 percent consistency) slurry required to obtain the desired basis weight. The slurry was then poured from the graduated cylinder into an 8.5-inch by 8.5-inch Valley handsheet mold (Valley Laboratory Equipment, Voith, Inc., Appleton, Wis.) that had been pre-filled to the appropriate level with water. After pouring the slurry into the mold, a predetermined amount of the nonionic polymer dispersion comprising microspheres was added to the mold and then the mold completely filled with water. The slurry was then agitated gently with a standard perforated mixing plate that was inserted into the slurry and moved up and down seven times, then removed. The water was then drained from the mold through a wire assembly at the bottom of the mold that retained the fibers to form an embryonic web. The forming wire was a 90 mesh, stainless-steel wire cloth. The web was couched from the mold wire with two blotter papers placed on top of the web with the smooth side of the blotter contacting the web. The blotters were removed and the embryonic web was lifted with the lower blotter paper, to which it was attached. The lower blotter was separated from the other blotter, keeping the embryonic web attached to the lower blotter. The blotter was positioned with the embryonic web face up, and the blotter was placed on top of two other dry blotters. Two more dry blotters were also placed on top of the embryonic web. The stack of blotters with the embryonic web was placed in a Valley hydraulic press and pressed for one minute with 100 psi applied to the web. The pressed web was removed from the blotters and placed on a Valley steam dryer containing steam at 2.5 pounds per square inch (psig) and heated for 2 minutes, with the wire-side surface of the web next to the metal drying surface and a felt under tension on the opposite side of the web. Felt tension was provided by 17.5 lbs. of weight pulling downward on an end of the felt that extends beyond the edge of the curved metal dryer surface. The dried handsheet was trimmed to 7.5 inches square with a paper cutter and then weighed in a heated balance with the temperature maintained at 105° C. to obtain the oven dry weight of the web.

Scanning electron microscopy (SEM) images of select handsheets were obtained using the JSM-6490LV scanning electron microscope under the following operating conditions: accelerating voltage is 10 kilovolts; spot size is 40, working distance 20 millimeters, and magnification from 100× to 500×. Handsheet cross-sections were prepared by cleaving the sheet with a fresh, razor blade at liquid nitrogen temperatures. The handsheet samples were mounted with double-stick tape and metalized with gold using a vacuum sputter for proper imaging in the SEM.

The physical properties of the handsheets are set forth below. The weight percentage of microspheres was calculated as follows: Wt % Microspheres=(Weight of Sample Sheet−Weight of Control Sheet)/Weight of Control Sheet.

TABLE 1

| Sample | Microsphere Dispersion (Wt %) | Sheet Weight (g) | Microspheres (Wt %) | Caliper (mm) | Bulk (cc/g) | Delta Bulk (%) |
|---|---|---|---|---|---|---|
| Control 1 | — | 2.16 | — | 0.172 | 2.89 | — |
| 1 | 40 | 2.34 | 8.3 | 0.334 | 5.18 | 94 |
| 2 | 80 | 2.48 | 14.8 | 0.393 | 5.75 | 129 |
| 3 | 160 | 2.56 | 18.5 | 0.547 | 7.75 | 218 |
| 4 | 320 | 2.66 | 23.1 | 0.755 | 10.31 | 339 |

Example 2

High Bulk Tissue Webs

Tissue basesheets were made using either a creped tissue making process or a throughdried papermaking processes, commonly referred to as "uncreped throughdried" ("UCTAD").

In all instances, northern softwood kraft (NSWK) pulp was dispersed in a pulper for 30 minutes at 1.6 percent consistency at about 100° F. The NSWK pulp was refined with a refiner built into the pulper for 3 to 15 minutes. The NSWK pulp was then transferred to a machine chest and subsequently diluted to approximately 0.27 percent consistency. Two kilograms Kymene™ 920A (12.5 percent solids) per metric ton of wood fiber was added to the NSWK pulp prior to the headbox in the machine chest. The softwood fibers were used as the inner strength layer in a 3-layer tissue structure. The NSWK layer contributed approximately about 30 percent of the final sheet weight.

Eucalyptus hardwood Kraft (EHWK) pulp was dispersed in a pulper for 30 minutes at about 1.6 percent consistency at about 100° F. The EHWK pulp was then transferred to a machine chest and subsequently diluted to about 0.14 percent consistency. The EHWK pulp fibers were used in the two outer layers of the 3-layered tissue structure. The EHWK layers contributed about 70 percent of the final sheet weight.

Figure 2A:
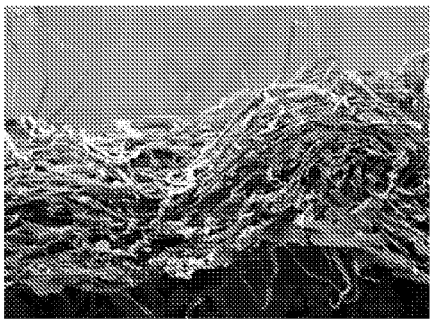
Figure 2B:
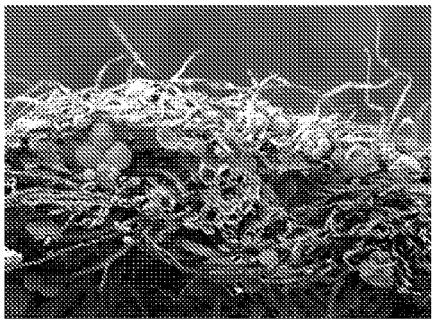

To prepare the creped tissue web, pulp fibers from the machine chests were pumped to the headbox at a consistency of about 0.02 percent. Pulp fibers from each machine chest were sent through separate manifolds in the headbox to create a 3-layered tissue structure. The fibers were deposited onto a felt in a fourdrenier type of former like that shown in FIG. 2. The wet sheet, about 10 to 20 percent consistency, was adhered to a Yankee dryer, traveling at about 50 to about 60 fpm (15 to 18 mpm) through a nip via a pressure roll. The consistency of the wet sheet after the pressure roll nip (post-pressure roll consistency or PPRC) was approximately 40 percent. The wet sheet is adhered to the Yankee dryer due to the creping composition that is applied to the dryer surface. The sheet was dried to about 98 to 99 percent consistency as it traveled on the Yankee dryer and to the creping blade. The creping blade subsequently scraped the tissue sheet and a portion of the creping composition off of the Yankee dryer. The creped tissue basesheet was then wound onto a core traveling at about 47 to about 52 fpm (15 to 17 mpm) into soft rolls for converting. The resulting tissue basesheet had a bone dry basis weight of about 14 gsm. Two soft rolls of the creped tissue were then rewound, calendared, and plied together so that both creped sides were on the outside of the 2-ply structure. Mechanical crimping on the edges of the structure held the plies together. The plied sheet was then slit on the edges to a standard width of approximately 8.5 inches and folded, and cut to facial tissue length. Tissue samples were conditioned and tested.

UCTAD webs were prepared as generally described in U.S. Pat. No. 5,607,551. Prior to forming, each stock was diluted to approximately 0.1 percent consistency and transferred to a 3-layered headbox in such a manner as to provide a layered web comprising about 70 percent EHWK and 35 percent NSWK, where the outer layers comprised EHWK and the center layer comprised NSWK. The formed web was non-compressively dewatered and rush-transferred to a transfer fabric traveling at a speed about 25 percent slower than the forming fabric. The web was then transferred to a through-drying fabric, dried and calendered. The resulting tissue basesheet had a bone dry basis weight of about 30 gsm.

The microsphere compositions were prepared by mixing the poly(vinyl alcohol) stabilized vinyl acetate-ethylene copolymer dispersion with water for 15 minutes, followed by the addition of nonionic surfactant, biocide and defoamer and mixing for an additional 15 minutes. Microspheres were then added with mixing for an additional 15 minutes. The weight percentages of individual components are set forth below. In instances where microspheres were added to the tissue web, the microspheres were added to the machine chest containing the NSWK slurry and mixed with the NSWK slurry for at least 15 minutes. Thus, when incorporated into the tissue web, the microspheres were added to the center layer of the three layered tissue web.

| Vinyl Acetate-Ethylene Copolymer with unexpanded Expancel ™ (VAE - UE) | |
|---|---|
| Component | Weight % |
| Poly(vinyl alcohol) stabilized Vinyl Acetate-Ethylene Copolymer Dispersion | 40% |
| Water | 25% |
| Nonionic Surfactant | 2% |
| Biocide | 0.5% |
| Defoamer | 0.5% |
| Unexpanded Expancel ™ Microspheres (031WUF40, Akzo Nobel) | 32% |

| Vinyl Acetate-Ethylene Copolymer with expanded Expancel ™(VAE - E) | |
|---|---|
| Component | Weight % |
| Poly(vinyl alcohol) stabilized Vinyl Acetate-Ethylene Copolymer Dispersion | 30% |
| Water | 62% |
| Nonionic Surfactant | 2% |
| Biocide | 0.5% |
| Defoamer | 0.5% |
| Expanded Expancel ™ Microspheres (920WE40D24 Akzo Nobel) | 5% |

The physical properties of tissue webs are summarized below.

TABLE 2

| Sample | Method of Manufacture | Micro-sphere Dispersion | Micro-sphere Dispersion (Wt %) | BW (gsm) | Caliper (mils) | GMT (g/3") | Bulk (cc/g) | Delta Bulk (%) |
|---|---|---|---|---|---|---|---|---|
| Control 2 | Creped | — | — | 28 | 10.5 | 642 | 9.53 | — |
| 5 | Creped | VAE-UE | 35.5 | 28 | 12.4 | 679 | 11.25 | 18.0 |
| 6 | Creped | VAE-E | 27.7 | 28 | 11.5 | 649 | 10.43 | 9.5 |
| Control 3 | UCTAD | — | — | 30 | 19.8 | 783 | 16.76 | |
| 7 | UCTAD | VAE-UE | 35.5 | 30 | 22.1 | 868 | 18.71 | 11.6 |
| 8 | UCTAD | VAE-E | 27.7 | 30 | 24.8 | 839 | 21.00 | 25.3 |

We claim:

1. An uncreped through-air dried tissue web consisting essentially of cellulosic fibers, a pre-expanded microsphere, a polyvinyl alcohol stabilized vinyl acetate-ethylene copolymer, and a nonionic surfactant, wherein the uncreped through-air dried tissue web has a basis weight from about 20 to about 45 grams per square meter (gsm) and a bulk from about 15 to about 25 cc/g.

2. The tissue web of claim 1 wherein the web comprises less than about 10 percent, by total weight of the web, pre-expanded microspheres.

3. A method of forming an uncreped through air dried high bulk tissue web consisting essentially of the steps:

a. mixing expandable microspheres, a vinyl acetate-ethylene copolymer, polyvinyl alcohol and a surfactant to form a nonionic dispersion polymer;

b. forming a cellulosic fiber slurry;

c. mixing the nonionic dispersion polymer and the cellulosic fiber slurry to form a mixture;

d. disposing the mixture on a forming fabric to form a tissue web; and e. through-air drying the tissue web, wherein the uncreped through-air dried tissue has a basis weight from about 20 to about 45 gsm and a bulk from about 15 to about 25 cc/g.

4. The method of claim 3 wherein the tissue web comprises less than about 10 percent, by total weight of the web, expandable microspheres.

5. The tissue web of claim 1 wherein the polyvinyl alcohol stabilized vinyl acetate-ethylene copolymer comprises from about 10 to about 35 percent by ethylene and from about 65 to about 90 percent by weight vinyl acetate.

6. The tissue web of claim 1 wherein the web comprises a polyvinyl alcohol having a degree of polymerization from about 200 to about 4,000 and a non-ionic surfactant.

7. The tissue web of claim 1 wherein the web comprises from about 0.5 to about 5 percent, by total weight of the web, pre-expanded microspheres.

8. An uncreped through-air dried tissue web having first, second and third fibrous layer, the second fibrous layer consisting essentially of cellulosic fibers, a pre-expanded microsphere, a polyvinyl alcohol stabilized vinyl acetate-ethylene copolymer, and a nonionic surfactant, and the first and second fibrous layers being substantially free from pre-expanded microspheres, wherein the uncreped through-air dried tissue web has a basis weight from about 20 to about 45 grams per square meter (gsm) and a bulk from about 15 to about 25 cc/g.

9. The tissue web of claim 8 wherein the web comprises from about 0.5 to about 5 percent, by total weight of the web, pre-expanded microspheres.

* * * * *